US008845375B2

(12) United States Patent
Lee

(10) Patent No.: US 8,845,375 B2
(45) Date of Patent: Sep. 30, 2014

(54) DISPOSABLE LIFE-SAVING GARMENT

(76) Inventor: Jong-Won Lee, Gunpo-shi (KR)

( * ) Notice: Subject to any disclaimer, the term of this patent is extended or adjusted under 35 U.S.C. 154(b) by 430 days.

(21) Appl. No.: 13/386,127

(22) PCT Filed: Jul. 1, 2010

(86) PCT No.: PCT/KR2010/004278

§ 371 (c)(1),
(2), (4) Date: Jan. 20, 2012

(87) PCT Pub. No.: WO2011/010811

PCT Pub. Date: Jan. 27, 2011

(65) Prior Publication Data

US 2012/0174297 A1 Jul. 12, 2012

(30) Foreign Application Priority Data

Jul. 22, 2009 (KR) ..... 10-2009-0067048
Mar. 26, 2010 (KR) ..... 10-2010-0027237

(51) Int. Cl.

| | |
|---|---|
| ***B63C 9/08*** | (2006.01) |
| ***A41D 13/002*** | (2006.01) |
| ***A62B 17/00*** | (2006.01) |
| ***A41D 13/01*** | (2006.01) |
| ***A41D 31/00*** | (2006.01) |

(52) U.S. Cl.

CPC ..... *A62B 17/003* (2013.01); *A41D 13/0025* (2013.01); *A41D 2400/52* (2013.01); *A41D 13/01* (2013.01); *A41D 31/0027* (2013.01)

USPC ..... 441/105; 441/87; 2/84

(58) Field of Classification Search

USPC ..... 441/87, 102, 104, 105, 106; 2/79, 82, 2/84, 108, 458

See application file for complete search history.

(56) References Cited

U.S. PATENT DOCUMENTS

| | | | | |
|---|---|---|---|---|
| 4,272,851 | A * | 6/1981 | Goldstein | 2/79 |
| 5,421,326 | A * | 6/1995 | Rankin et al. | 2/458 |
| 6,279,162 | B1 * | 8/2001 | Silverthorn | 441/87 |
| 2004/0237178 | A1 | 12/2004 | Landeros | |

FOREIGN PATENT DOCUMENTS

| | | |
|---|---|---|
| JP | 06-036652 | 5/1994 |
| JP | 06-225948 | 8/1994 |
| KR | 10-2008-0042775 | 5/2008 |
| KR | 10-20080068489 | 8/2008 |

* cited by examiner

*Primary Examiner* — Lars A Olson
(74) *Attorney, Agent, or Firm* — Greer, Burns & Crain, Ltd.

(57) ABSTRACT

A disposable life-saving garment for use in the event of fire, comprises a body-protecting portion and a head-protecting portion. The body-protecting portion is configured with a lining formed to enclose the body of a wearer and a cover covering the liner, the cover being made of a sealed material that can block the passage of air. A closed air passage is formed between the liner and cover. A compressed air tank is installed in a pocket of the cover and is connected to the air passage through a check valve. An intake hose supplies compressed air from the air passage of the body-protecting portion to the head-protecting portion. The head-protecting portion has a heat-resistant transparent window and a one-way outlet unit. The body-protecting portion and the head-protecting portion are made of a nonflammable material or a fire retardant material.

8 Claims, 4 Drawing Sheets

DISPOSABLE LIFE-SAVING GARMENT

This application is a U.S. National Stage under 35 U.S.C. §371 of International Application No. PCT/KR2010/004278, filed Jul. 1, 2010, which claims priority from Korean Patent Application No. 10-2009-0067048, filed Jul. 22, 2009, and Korean Patent Application No. 10-2010-0027237, filed Mar. 26, 2010.

TECHNICAL FIELD

The present invention relates to a disposable life-saving garment for use in the event of a fire, and more particularly, to such a disposable life-saving garment suitable for an emergency such as in the event of a fire, which can be conveniently carried and worn, can save lives as it is used quickly by users without any special training, is simple in construction to reduce the manufacturing costs, has high utility by virtue of simple manipulation and use thereof, and can help wearers escape by protecting their respiratory systems against noxious fumes and smoke in a fire to save lives.

BACKGROUND ART

In general, gas masks is used to protect a respiratory system of a person in a fire scene against toxic fumes and smoke and prevent him or her from being suffocated to protect his or her body from a danger at the outbreak of a fire. Originally, the gas masks have been developed as tools that are intended to protect soldiers against a biochemical gas attack from an enemy in a battle ground. In addition, a variety of types of gas masks have been improved and developed depending on emergencies.

In recent days, there is an urgent need for a simplified gas mask that is quickly worn by a person in a fire site so that he or she can escape from the fire site when a fire occurs at a public transportation means such as a bus, a subway, or the like, a department store, a hotel, a theater, etc., which are closed spaces where the general public gather, that is simply configured to be able to be utilized only for a time suitable for escape from the fire site, and that is easy for general citizens to carry.

DISCLOSURE OF INVENTION

Technical Problem

Accordingly, the present invention has been made in order to solve the above-mentioned problems, and it is an object of the present invention to provide a disposable life-saving garment suitable for an emergency such as in the event of a fire, which can be conveniently carried and worn, can save lives as it is used quickly by users without any special training, is simple in construction to reduce the manufacturing costs, has high utility by virtue of simple manipulation and use thereof, and can help wearers escape by protecting their respiratory systems against noxious fumes and smoke in a fire to save lives.

Another object of the present invention is to provide a disposable life-saving garment configured such that when a person whose body contour is small relatively wears the disposable life-saving garment, he or she can fasten the both arm portions of the arm-protecting section with the second auxiliary belt after rolling his or her garment sleeves up.

Technical Solution

To accomplish the above objects, according to an exemplary embodiment of the present invention, there is provided a disposable life-saving garment including: a body-protecting section comprising a lining configured to enclose the body of a wearer and a cover configured to cover the lining, the cover being made of a sealed material that can block the passage of air, wherein a closed air passage is defined between the lining and the cover to act as a passage for the flow of compressed air or oxygen, a compressed air tank containing compressed air or oxygen is installed in a first pocket formed at one side of the front surface of the cover, the compressed air tank being connected to an openable and closable check valve through a first connecting portion, the check valve being connected to one end of the air passage through a second connecting portion, and an intake hose for taking in compressed air or oxygen being supplied to the air passage is connected to the other end of the air passage; and a head-protecting section connected to the top of the body-protecting section and configured to enclose the head of the wearer, the head-protecting section comprising a heat-resistant see-through window installed at the front thereof to correspond to the position of the eyes of the wearer, and a one-way outlet unit installed below the see-through window to only discharge the exhaled breath of the wearer during respiration to the outside, wherein the intake hose is fixed in position by a fixing latch installed at a side of the one-way outlet unit, and wherein the body-protecting section and the head-protecting section are made of a nonflammable material or a fire retardant material.

According to an exemplary embodiment of the present invention, the disposable life-saving garment further include: an arm-protecting section respectively coupled to both sides of the body-protecting section and configured to enclose the arms of the wearer, the arm-protecting section including a mitten attached to a lower end thereof; and a flexible waistband installed along a circumference of a lower end of the body-protecting section and having a fur cloth attached to the inner surface thereof, wherein the arm-protecting section and the waistband are made of a nonflammable material or a fire retardant material.

According to an exemplary embodiment of the present invention, the head-protecting section includes an LED lamp mounted above the see-through window, and a battery box or a cell phone jack installed in a second pocket formed at the other side of the front surface of the cover such that the LED lamp is supplied with electric power from the battery box or the cell phone jack to emit light.

In addition, in the disposable life-saving garment according to an exemplary embodiment of the present invention, the check valve is installed between the first connecting portion 와 second connecting portion such that when the check valve is opened, compressed air or oxygen contained in the compressed air tank can be injected into the air passage in one direction.

Moreover, according to an exemplary embodiment of the present invention, the head-protecting section includes an outer member and an inner member so that a plurality of impact-absorbing spaces is defined between the outer member and the inner member so as to allow air to be sealingly contained therein, and a face protective portion disposed between the outer member and the inner member at a region that enclose a face of the wearer, the face protective portion being made of a plastic material.

Besides, according to an exemplary embodiment of the present invention, the waistband includes a pair of opposed first auxiliary belts attached to a rear surface thereof such that the waistband is tightly fastened around the waist of the wearer by positioning the first auxiliary belts at the front surface of the waistband, and the arm-protecting section includes a second auxiliary belt attached respectively to both arm portions thereof such that the second auxiliary belt is tightly fastened around the arms of the wearer.

In addition, according to an exemplary embodiment of the present invention, the one-way outlet unit includes a mesh element installed at a front surface thereof, and a rubber plate disposed at the rear of the mesh element and retained on a retaining step protrudingly formed inwardly from the inner wall thereof such that the exhaled breath during respiration of the wearer is discharged to the outside through the mesh element, and wherein the one-way outlet un unit uses a one-way valve that prevents the inhaled breath or outdoor air during respiration is prevented from being introduced into the head-protecting section by the rubber plate such that the backflow of the inhaled breath and outdoor is not permitted.

Further, according to an exemplary embodiment of the present invention, the body-protecting section comprises a fastening belt attached to both sides of the interior of the first pocket in which the compressed air tank is disposed respectively such that the compressed air tank is fixed in position within the first pocket by the fastening belt.

In addition, according to an exemplary embodiment of the present invention, the body-protecting section further includes a pumping unit installed in the first pocket, wherein the pumping unit includes: a pumping member having an intake hole and a discharge hole formed therein; an extension hose coupled at one end thereof to the intake hole of the pumping member and configured to be received in the first pocket; a second pumping connecting portion coupled at one end thereof to the discharge hole of the pumping member; an openable and closable check valve connected to the other end of the second pumping connecting portion; a first pumping connecting portion connected at one end thereof to the check valve and connected at the other end thereof to one end of the air passage; and valvular members configured to prevent the backflow of outdoor air introduced into the air passage via the extension hose and the pumping member.

Advantageous Effects

As described above, according to the present invention, the disposable life-saving garment is suitable for an emergency such as in the event of a fire, can be conveniently carried and worn, can save lives as it is used quickly by users without any special training, is simple in construction to reduce the manufacturing costs, has high utility by virtue of simple manipulation and use thereof, and can help wearers escape by protecting their respiratory systems against noxious fumes and smoke in a fire to save lives.

In addition, when a person whose body contour is small relatively wears the disposable life-saving garment, he or she can fasten the both arm portions of the arm-protecting section with the second auxiliary belt after rolling his or her garment sleeves up. Further, since the LED lamp is formed in a bellows structure shape so as to be freely moved in vertical and horizontal directions such that the LED lamp guides a way to the wearer and secures a view.

EXPLANATION ON REFERENCE NUMERALS OF THE MAIN ELEMENTS OF THE DRAWINGS

Figure 1:
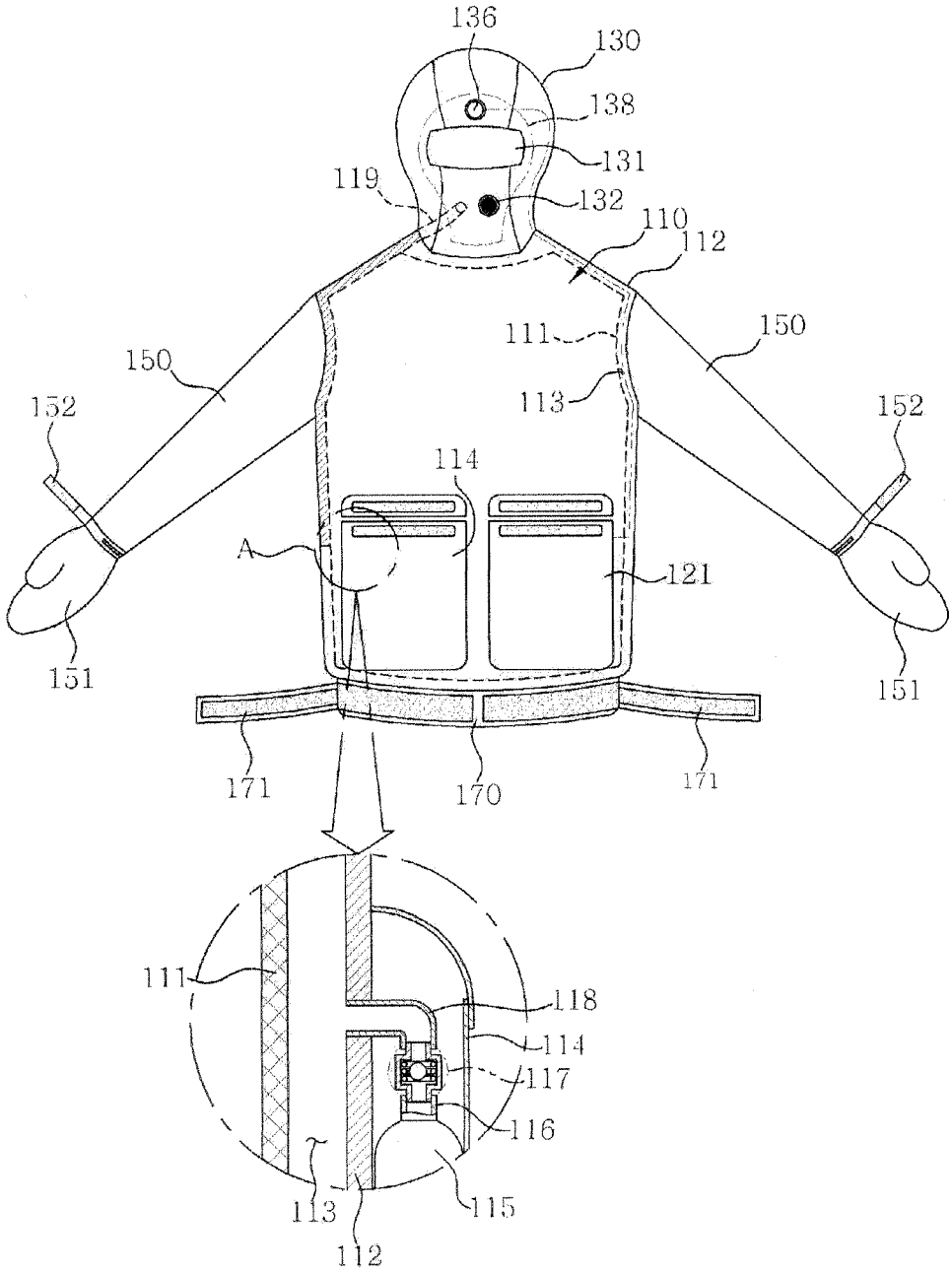
FIG. 1 is a view illustrating a disposable life-saving garment according to the present invention in elevation.

| | |
|---|---|
| 100: disposable life-saving garment according to the present invention | |
| 110: body-protecting section | 111: cover |
| 112: lining | 113: air passage |
| 114: first pocket | 115: compressed air tank |
| 116: first connecting portion | 117: check valve |
| 118: second connecting portion | 119: intake hose |
| 120: fastening belt | 121: second pocket |
| 122: battery box | 123: cell phone jack |
| 130: head-protecting section | |
| 131: see-through window | |
| 132: one-way outlet unit | 133: rubber plate |
| 134: mesh element | 135: fixing latch |
| 136: LED lamp | 137: impact-absorbing space |
| 138: face protective portion | 139: retaining step |
| 150: arm-protecting section | 151: mitten |
| 152: second auxiliary belt | 160: pumping unit |
| 161: first pumping connecting portion | |
| 162: check valve | |
| 163: second pumping connecting portion | |
| 164: pumping member | |
| 165a, 165b: valvular members | 166: extension hose |
| 170: waistband | 171: first auxiliary belt |

BEST MODE FOR CARRYING OUT THE INVENTION

Now, a preferred embodiment of according to the present invention will be described hereinafter in detail with reference to the accompanying drawings such that those skilled in that art to which the present invention pertains can easily carry out the embodiment.

The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

A disposable life-saving garment according to a preferred embodiment of the present invention will be described hereinafter in detail with reference to the accompanying drawings.

FIG. 1 is a view illustrating a disposable life-saving garment according to the present invention in elevation.

Referring to FIG. 1, a disposable life-saving garment 100 includes a body-protecting section 110, a head-protecting section 130, an arm-protecting section 150, and a waistband 170.

Preferably, the body-protecting section 110, the head-protecting section 130, the arm-protecting section 150, and the waistband 170 are made of a nonflammable material or a fire retardant material, which is resistant to heat, is thin, and is lightweight.

In addition, the body-protecting section 110, the head-protecting section 130, the arm-protecting section 150, and the waistband 170 are formed integrally with each other, and thus the disposable life-saving garment 100 is preferably made in the biggest possible size so that anyone can wear the life-saving garment.

The body-protecting section 110 includes a cover 111, a lining 112, an air passage 113, a first pocket 114, a compressed air tank 115, a first connecting portion 116, a check valve 117, a second connecting portion 118, an intake hose 119, a fastening belt 120, a second pocket 121, a battery box 122, and a cell phone jack 123, The body-protecting section 110 includes a lining ill configured to enclose the body of a wearer and a cover 112 configured to cover the lining 111. A closed air passage 112 is defined between the lining 111 and the cover 112 to act as a passage for the flow of compressed air or oxygen.

The cover 112 is necessarily should be made a sealed material such as vinyl and the like that can block the passage of air.

The lining 111 also preferably blocks the passage of air, but does not necessarily need to be made of the sealed material such as vinyl and the like such as the cover 112.

Figure 2:
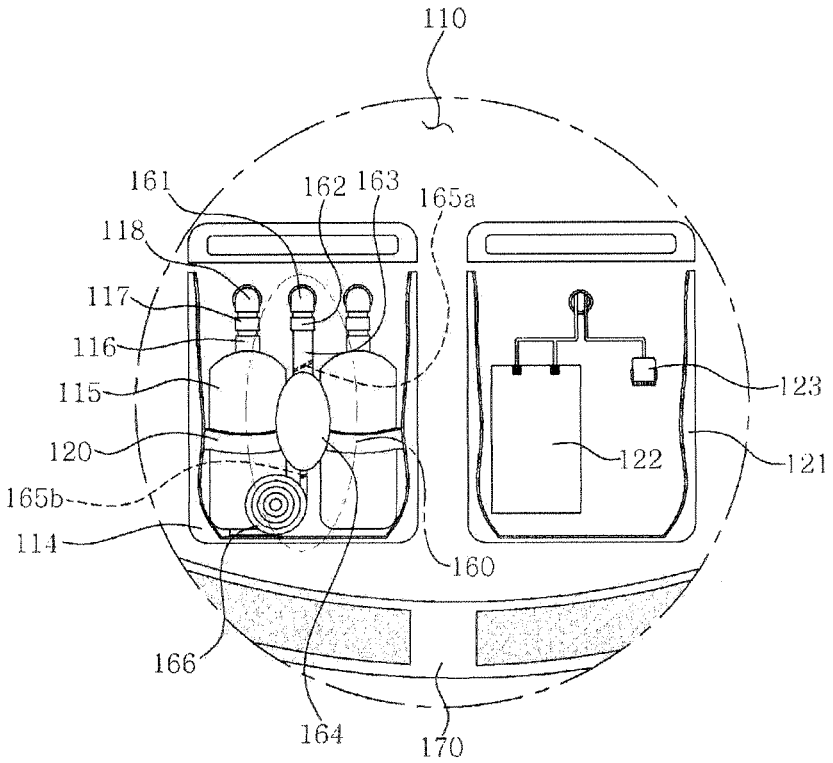
FIG. 2 is a view illustrating the inner construction of a first pocket and a second pocket of a disposable life-saving garment according to an embodiment of the present invention.

FIG. 2 is a view illustrating the inner construction of a first pocket and a second pocket of a disposable life-saving garment according to an embodiment of the present invention.

As shown in FIG. 2, a compressed air tank 115 containing compressed air or oxygen is installed in a first pocket 114 formed at one side of the front surface of the cover 112, and a battery box 122 or a cell phone jack 123 is installed in a second pocket 121 formed at the other side of the front surface of the cover 112.

In addition, preferably, the body-protecting section includes a fastening belt 120 attached to both sides of the interior of the first pocket 114, respectively such that the compressed air tanks 115 are fixed in position within the first pocket 114 by the fastening belt 120.

The compressed air tanks 115 are installed in the first pocket 114, and compressed air or oxygen from the compressed air tanks is supplied to a wearer such that he or she can breathe for the time when he or she can escape from a fire scene when a fire occurs A first connecting portion 116 connected to the compressed air tank 115 and a second connecting portion 118 connected to a lower portion of the air passage 113 are fitted to each other, and a check valve 17 is installed at the top of the compressed air tank 115.

As the check valve 117 is opened or closed, compressed air or oxygen is supplied to the air passage 113 or the supply thereof is interrupted. An intake hose 119 that takes in compressed air or oxygen being supplied to the air passage 113 is connected to an upper portion of the air passage 113.

In this case, the first connecting portion 116 and the check valve 117 are preferably previously installed at the compressed air tank 115. When the compressed air or oxygen contained in the compressed air tank 115 is completely consumed, the first connecting portion 116 and the second connecting portion 118 of a newly replaced compressed air tank 115 are fitted to each other such that compressed air or oxygen can be utilized conveniently.

That is, the check valve 117 is mounted between the first connecting portion 116 and the second connecting portion 118 and is opened such that the compressed air or oxygen contained in the compressed air tank 115 can be injected into the air passage 113 in one direction.

The head-protecting section 130 includes a see-through window 131, a one-way outlet unit 132, a rubber plate 133, a mesh element 134, a fixing latch 135, an LED lamp 136, an impact-absorbing space 137, a face protective portion 138, and a retaining step 139.

The head-protecting section 130 is connected to the top of the body-protecting section 110 and is configured to enclose the head of the wearer.

Figure 3:
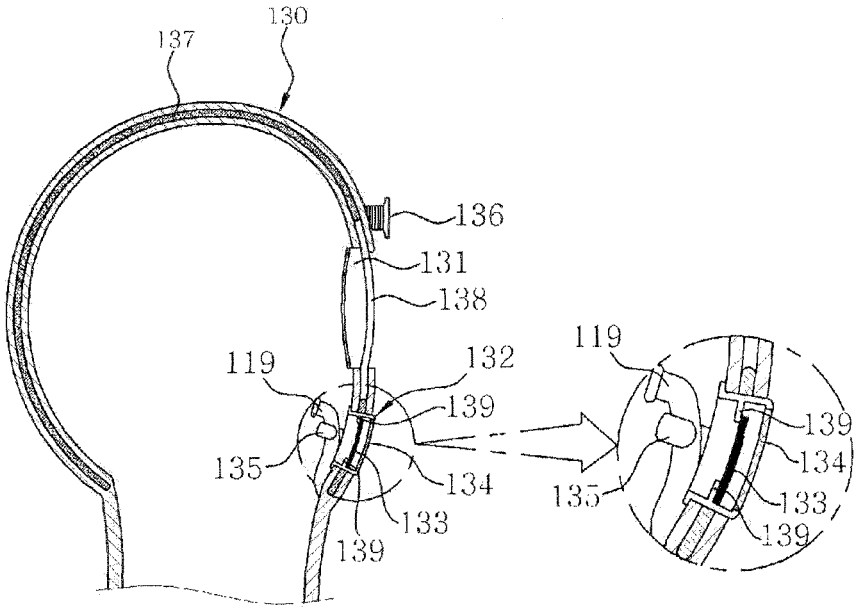
FIG. 3 is a view illustrating a side of a head-protecting section of a disposable life-saving garment according to the present invention.

FIG. 3 is a view illustrating a side of a head-protecting section of a disposable life-saving garment according to the present invention.

The head-protecting section 130 includes an outer member and an inner member made of a softer material than that of the outer member. In addition, the head-protecting section 130 includes a plurality of impact-absorbing spaces 137 defined between the outer member and the inner member so as to allow air to be sealingly contained therein.

The impact-absorbing spaces 137 serve to absorb an external impact, and allow an impact to be less applied to a face of the wearer.

Moreover, the head-protecting section 130 includes a face protective portion of a plastic material disposed between the outer member and the inner member at a region that enclose a face of the wearer.

The face protective portion 138 is formed in the shape of a rigid mask that is made of a fire retardant material such as plastic. The face protective portion 138 serves to protect a face of the wearer to absorb an impact applied to the face of the wearer.

Further, the head-protecting section 130 includes a heat-resistant see-through window 131 installed at the front thereof to correspond to the position of the eyes of the wearer. The see-through window 131 is implemented as a transparent window that is equipped with anti-fog features to prevent blurring of vision to secure a view. The see-through window 131 is preferably made of a plastic material that is resistant to heat.

In addition, preferably, the head-protecting section 130 includes an LED lamp 136 mounted above the see-through window 131, and a battery box 122 or a cell phone jack 136 installed in the second pocket 121 such that the LED lamp 136 is supplied with electric power from the battery box 122 or the cell phone jack 136 to emit light.

Any one of the battery box 122 and the cell phone jack 123 may be selectively used. When the power of the battery box 122 is completely exhausted and the LED lamp 136 is not supplied with electric power from the battery box 122, the cell phone jack 123 may be connected to a cell phone of the wearer such that the LED lamp 136 emits light even in case of emergency.

Since the LED lamp 136 is a means for guiding a way to the wearer. The LED lamp 36 is formed in a bellows structure shape so as to be freely moved in vertical and horizontal directions such that the wearer can easily manipulate the LED lamp 136.

In addition, the head-protecting section 130 includes a one-way outlet unit 132 installed below the see-through window 131 to only discharge the exhaled breath of the wearer during respiration to the outside.

The one-way outlet unit 132 is well-known in the art and is used widely, and thus the detailed description of the construction thereof will be omitted to avoid redundancy.

The one-way outlet unit 132 includes a mesh element 134 installed at a front surface thereof, and a rubber plate 133 disposed at the rear of the mesh element 134 and retained on a retaining step 139 protrudingly formed inwardly from the inner wall thereof such that the exhaled breath during respiration of the wearer is discharged to the outside through the mesh element 134.

In addition, the one-way outlet unit 132 preferably uses a one-way valve that prevents the inhaled breath or outdoor air during respiration is prevented from being introduced into the head-protecting section by the rubber plate 133 such that the backflow of the inhaled breath and outdoor is not permitted.

In other words, when the exhaled breath during respiration of the wearer is discharged from his or her mouth, one side of the rubber plate 133 retained on the retaining step 139 is brought into close contact with the mesh element 134 while protruding forwards, and at the same time the exhaled breath is discharged to the outside through the mesh element 134 via a space created when the rubber plate 133 protrudes.

Moreover, although the inhaled breath during respiration of the wearer is introduced into the head-protecting section through the mesh element 134, the rubber plate 133 retained on the retaining step 139 does not protrude backwards such that the inhaled breath or the outdoor air is prevented from being introduced into the head-protecting section.

Besides, in the head-protecting section 130, the intake hose 119 connected to the upper portion of the air passage 113 is fixed in position by a fixing latch installed at a side of the one-way outlet unit 132.

The intake hose 119 and the one-way outlet unit 132 are disposed in such a manner as to be spaced apart from each other at a predetermined interval such that the inhaled breath and the exhaled breath during inspiration of the wearer move at a relatively high rate.

The arm-protecting section 150 includes a mitten 151 and a second auxiliary belt 152.

The arm-protecting section 150 is respectively coupled to both sides of the body-protecting section 130 and is configured to enclose the arms of the wearer. The mitten 15 is attached to the lower end of the arm-protecting sections 150.

The mitten 15 acts to block outdoor air from being introduced into a hand portion of the arm-protecting section. On the inner surface of the mitten 15, which face hands of the wearer, is formed a cloth including a silver foil material such that the transfer of heat is prevented, and flame retardancy and waterproof are ensured.

The arm-protecting section 150 includes a second auxiliary belt 152 attached respectively to both arm portions thereof such that when a person whose body contour is small relatively wears the disposable life-saving garment, he or she can fasten the both arm portions of the arm-protecting section with a second auxiliary belt 152 after rolling his or her garment sleeves up.

The waistband 170 includes a first auxiliary belt 171.

The waistband 170 is installed along a circumference of a lower end of the body-protecting section 130, and is preferably made of a flexible material to block outdoor air from being introduced into the body-protecting section.

The waistband 170 has a fur cloth attached to the inner surface thereof such that air is more effectively blocked from being introduced into the disposable life-saving garment 100 by means of fur.

The waistband 170 includes a pair of opposed first auxiliary belts 171 attached to a rear surface thereof such that the waistband 170 is tightly fastened around the waist of the wearer by positioning the first auxiliary belts 171 at the front surface of the waistband 170, and thus the waist of a wearer whose waistband 170 is too loose can be double-fastened.

Figure 4:
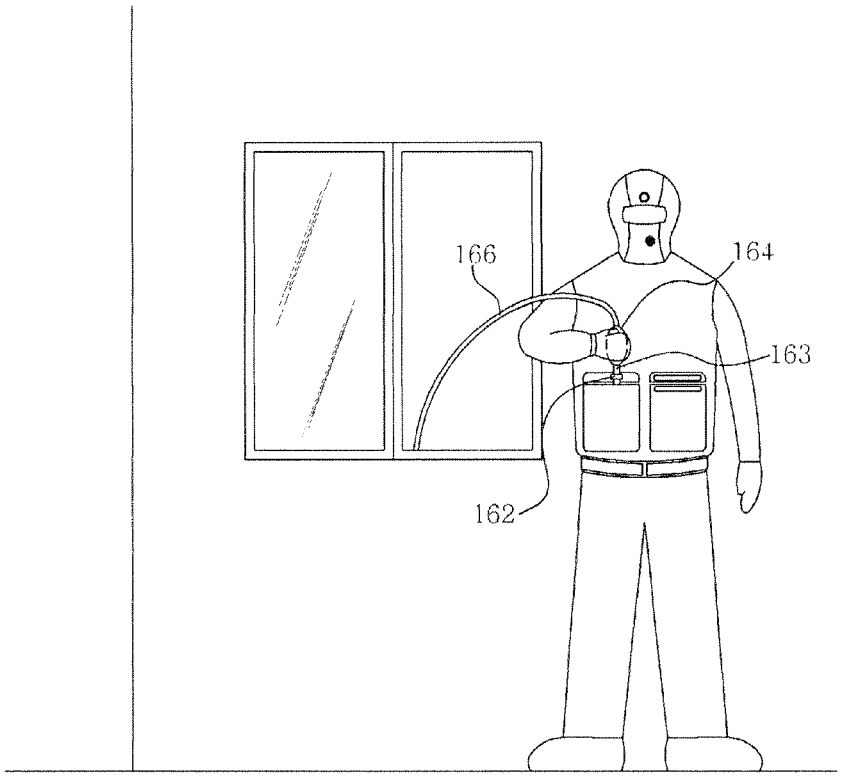
FIG. 4 is a view illustrating the use state of a disposable life-saving garment according to the present invention, wherein a person at a fire site inhales fresh air from the outside of a building through a window in the event of a fire.

Also, as shown in FIGS. 2 and 4, the body-protecting section 110 may further include a pumping unit 150 installed in the first pocket 114.

FIG. 2 is a view illustrating the inner construction of a first pocket and a second pocket of a disposable life-saving garment according to an embodiment of the present invention, and FIG. 4 is a view illustrating the use state of a disposable life-saving garment according to the present invention, wherein a person at a fire site inhales fresh air from the outside of a building through a window in the event of a fire.

Referring to FIGS. 2 and 4, the pumping unit 160 includes: a pumping member 164 having an intake hole and a discharge hole formed therein; an extension hose 166 coupled at one end thereof to the intake hole of the pumping member and configured to be received in the first pocket 114; a second pumping connecting portion 163 coupled at one end thereof to the discharge hole of the pumping member 164; an openable and closable check valve 162 connected to the other end of the second pumping connecting portion 163; a first pumping connecting portion 161 connected at one end thereof to the check valve 162 and connected at the other end thereof to one end of the air passage; and valvular members 165*a* and 165*b* configured to prevent the backflow of outdoor air introduced into the air passage via the extension hose 166 and the pumping member 164, Thus, as shown in FIG. 4, in a state where the extension hose 166 is extended to the outside of a building in the event of a fire, when a wearer in the fire site can inhale fresh air from the outside of the building through the depression and release operation of the pumping member 164 made of as an elastic material such as rubber or the like such that a safe respiration is ensured. In this case, the outdoor air being introduced into the air passage via the extension hose 166 and the pumping member 164 is prevented from flowing backwards by the valvular members 165*a* and 165*b*.

While the present invention has been described with respect to the certain specific embodiments, it will be obvious to a person of ordinary skill in the art that the present invention is not limited to the above embodiments, but various equivalent modifications and variations to the disclosed embodiments can be made without departing from the spirit and scope of the present invention. Therefore, it is intended that the appended claims cover all such modifications and variations as fall within the true spirit and scope of the invention.

The invention claimed is:

1. A disposable life-saving garment comprising:

a body-protecting section comprising a lining configured to enclose the body of a wearer and a cover configured to cover the lining, the cover being made of a sealed material that can block the passage of air, wherein a closed air passage is defined between the lining and the cover to act as a passage for the flow of compressed air or oxygen, a compressed air tank containing compressed air or oxygen is installed in a first pocket formed at one side of the front surface of the cover, the compressed air tank being connected to an openable and closable check valve through a first connecting portion, the check valve being connected to one end of the air passage through a second connecting portion, and an intake hose for taking in compressed air or oxygen being supplied to the air passage is connected to the other end of the air passage; and a head-protecting section connected to the top of the body-protecting section and configured to enclose the head of the wearer, the head-protecting section comprising a heat-resistant see-through window installed at the front thereof to correspond to the position of the eyes of the wearer, and a one-way outlet unit installed below the see-through window to only discharge the exhaled breath of the wearer during respiration to the outside, wherein the intake hose is fixed in position by a fixing latch installed at a side of the one-way outlet unit, and wherein the body-protecting section and the head-protecting section are made of a nonflammable material or a fire retardant material.

2. The disposable life-saving garment according to claim 1, further comprising:

an arm-protecting section respectively coupled to both sides of the body-protecting section and configured to enclose the arms of the wearer, the arm-protecting section including a mitten attached to a lower end thereof; and a flexible waistband installed along a circumference of a lower end of the body-protecting section and having a fur cloth attached to the inner surface thereof, wherein the arm-protecting section and the waistband are made of a nonflammable material or a fire retardant material.

3. The disposable life-saving garment according to claim 1, wherein the head-protecting section comprises an LED lamp mounted above the see-through window, and a battery box or a cell phone jack installed in a second pocket formed at the other side of the front surface of the cover such that the LED lamp is supplied with electric power from the battery box or the cell phone jack to emit light.

4. The disposable life-saving garment according to claim 1, wherein the head-protecting section comprises an outer member and an inner member so that a plurality of impact-absorbing spaces is defined between the outer member and the inner member so as to allow air to be sealingly contained therein, and a face protective portion disposed between the outer member and the inner member at a region that enclose a face of the wearer, the face protective portion being made of a plastic material.

5. The disposable life-saving garment according to claim 2, wherein the waistband comprises a pair of opposed first auxiliary belts attached to a rear surface thereof such that the waistband is tightly fastened around the waist of the wearer by positioning the first auxiliary belts at the front surface of the waistband, and the arm-protecting section comprises a second auxiliary belt attached respectively to both arm portions thereof such that the second auxiliary belt is tightly fastened around the arms of the wearer.

6. The disposable life-saving garment according to claim 1, wherein the one-way outlet unit comprises a mesh element installed at a front surface thereof, and a rubber plate disposed at the rear of the mesh element and retained on a retaining step protrudingly formed inwardly from the inner wall thereof such that the exhaled breath during respiration of the wearer is discharged to the outside through the mesh element, and wherein the one-way outlet unit uses a one-way valve that prevents the inhaled breath or outdoor air during respiration is prevented from being introduced into the head-protecting section by the rubber plate such that the backflow of the inhaled breath and outdoor air is not permitted.

7. The disposable life-saving garment according to claim 1, wherein the body-protecting section comprise a fastening belt attached to both sides of the interior of the first pocket in which the compressed air tank is disposed respectively such that the compressed air tank 115 is fixed in position within the first pocket by the fastening belt.

8. The disposable life-saving garment according to claim 1, wherein the body-protecting section further comprises a pumping unit installed in the first pocket, wherein the pumping unit comprises: a pumping member having an intake hole and a discharge hole formed therein; an extension hose coupled at one end thereof to the intake hole of the pumping member and configured to be received in the first pocket; a second pumping connecting portion coupled at one end thereof to the discharge hole of the pumping member; an openable and closable check valve connected to the other end of the second pumping connecting portion; a first pumping connecting portion connected at one end thereof to the check valve and connected at the other end thereof to one end of the air passage; and valvular members configured to prevent the backflow of outdoor air introduced into the air passage via the extension hose and the pumping member.

* * * * *